US011267032B2

(12) United States Patent
Flehmig et al.

(10) Patent No.: US 11,267,032 B2
(45) Date of Patent: Mar. 8, 2022

(54) METHOD FOR PRODUCING SHEET METAL COMPONENTS AND DEVICE THEREFOR

(71) Applicants: ThyssenKrupp Steel Europe AG, Duisburg (DE); thyssenkrupp AG, Essen (DE)

(72) Inventors: Thomas Flehmig, Ratingen (DE); Martin Kibben, Dinslaken (DE); Daniel Nierhoff, Mülheim a. d. Ruhr (DE); Arndt Marx, Mettlach-Orscholz (DE); Daniel Caspary, Abentheuer (DE)

(73) Assignee: thyssenknupp AG, Essen (DE)

( * ) Notice: Subject to any disclaimer, the term of this patent is extended or adjusted under 35 U.S.C. 154(b) by 258 days.

(21) Appl. No.: 16/475,474

(22) PCT Filed: Jan. 2, 2018

(86) PCT No.: PCT/EP2018/050039
§ 371 (c)(1),
(2) Date: Jul. 2, 2019

(87) PCT Pub. No.: WO2018/127480
PCT Pub. Date: Jul. 12, 2018

(65) Prior Publication Data

US 2020/0384522 A1 Dec. 10, 2020

(30) Foreign Application Priority Data

Jan. 5, 2017 (DE) ..... 10 2017 200 115.1

(51) Int. Cl.
*B21D 22/22* (2006.01)
*B21D 22/30* (2006.01)
(Continued)

(52) U.S. Cl.
CPC ..... *B21D 22/22* (2013.01); *B21D 22/30* (2013.01); *B21D 24/04* (2013.01); *B21D 24/16* (2013.01); *B21D 37/10* (2013.01)

(58) Field of Classification Search
CPC ..... B21D 24/16; B21D 22/20; B21D 22/22; B21D 22/30; B21D 24/04; B21D 24/10
(Continued)

(56) References Cited

U.S. PATENT DOCUMENTS 8,261,591 B2 * 9/2012 Hielscher ..... B21D 22/022 72/350
8,522,593 B2 9/2013 Flehmig et al.
(Continued)

FOREIGN PATENT DOCUMENTS

CN 102665956 A 9/2012
CN 105121050 A 12/2015
(Continued)

OTHER PUBLICATIONS

German Office Action for DE Application No. 10 2017 200 115.1 dated Dec. 7, 2017.
(Continued)

*Primary Examiner* — Adam J Eiseman
*Assistant Examiner* — Fred C Hammers
(74) *Attorney, Agent, or Firm* — RMCK Law Group PLC

(57) ABSTRACT

The present invention relates to a method for producing a dimensionally stable sheet metal component, wherein the method includes preforming a metal sheet into a sheet metal preform comprising at least one base region, a frame region, a transitional region between the base region and the frame region, optionally a flange region and a transitional region between the frame region and the flange region, wherein at least one of the regions comprises excess material at least in portions. The sheet metal preform is cut at least in portions
(Continued)

to form a cut sheet metal preform with a sheet metal preform The sheet metal preform is one of swagged and calibrated which has been cut at least in portions to form a substantially finished formed sheet metal component.

4 Claims, 3 Drawing Sheets

(51) Int. Cl.
*B21D 24/04* (2006.01)
*B21D 24/16* (2006.01)
*B21D 37/10* (2006.01)

(58) Field of Classification Search
USPC ..... 72/348
See application file for complete search history.

(56) References Cited

U.S. PATENT DOCUMENTS

2010/0133724 A1 6/2010 Flehmig et al.
2012/0282482 A1* 11/2012 Flehmig ..... B21D 51/02 428/603
2016/0052037 A1* 2/2016 Flehmig ..... B21D 22/30 72/347
2016/0067757 A1 3/2016 Flehmig et al.
2017/0225216 A1 8/2017 Flehmig et al.

FOREIGN PATENT DOCUMENTS

CN 105307790 A 2/2016
DE 102007059251 A1 6/2009
DE 102009059197 A1 6/2011
DE 102008037612 1/2014
DE 102013103612 A1 10/2014
DE 102013103751 A1 10/2014
EP 2217393 B1 3/2012
JP H1190556 A 4/1999
WO 2011083008 A1 7/2011

OTHER PUBLICATIONS

International Search Report for International Application No. PCT/EP2018/050039 dated Mar. 21, 2018.
Search Report for CN Application No. 201880005917.7 dated Mar. 4, 2020.

* cited by examiner

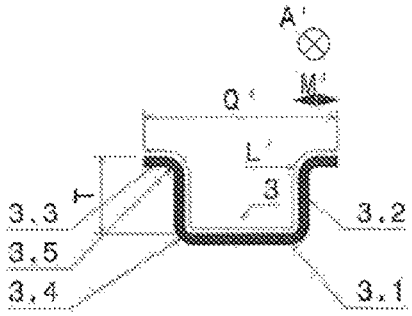
Figure 4b)
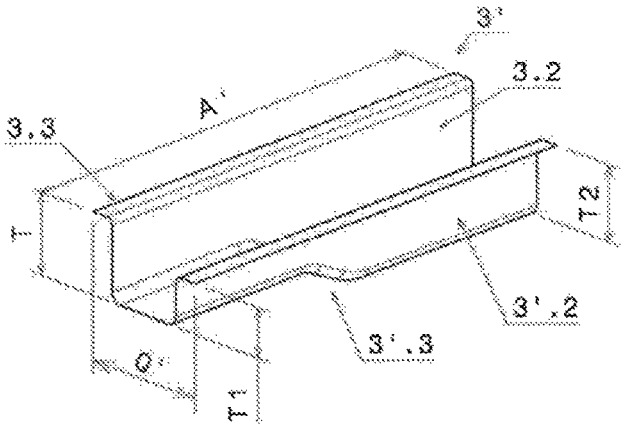
Figure 5)
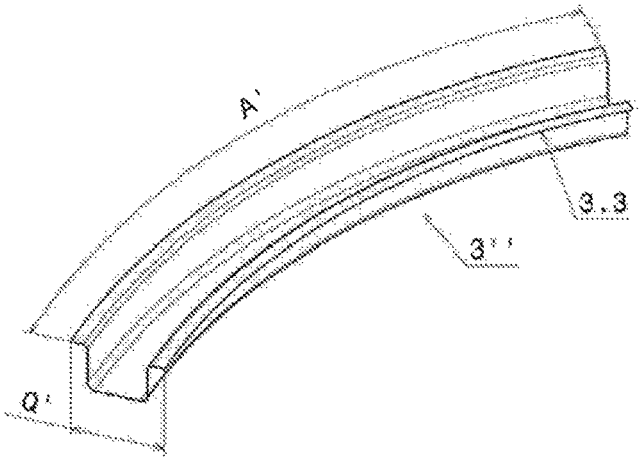
Figure 6)

METHOD FOR PRODUCING SHEET METAL COMPONENTS AND DEVICE THEREFOR

CROSS-REFERENCE TO RELATED APPLICATIONS

This application is a 371 U.S. National Stage of International Application No. PCT/EP2018/050039, filed Jan. 2, 2018, which claims priority to German Application No. 10 2017 200 115.1 filed on Jan. 5, 2017. The disclosure of each of the above applications is incorporated herein by reference in their entirety.

FIELD

The invention relates to a method and a device for producing of sheet metal components.

BACKGROUND

Deep drawing is usually employed as a proven forming method for the production of sheet metal components with complex geometry. A preferably flat blank is clamped between a hold-down device or blank holder and a drawing ring or die bearing surface and then drawn into a die by means of a stamp. The device for this is used in single or also multiple action presses.

Usually the margin of the component after the deep drawing has a smaller circumference than the blank that was used. In order to prevent the forming of folds and/or an increase of the sheet thickness due to the material excess present during the forming process, the friction between metal sheet and hold-down device is adjusted using a definite hold-down device force or other measures, such as drawing beads or the like, so that necessary regions of the component are stretched to the utmost and no cracks or folds are produced. In this way, tensile stresses are superimposed on the compressive stresses initiated by the material excess in the circumferential direction and thus local thickening of the material is for the most part prevented. In addition, deep drawing has the advantage that the large plastic strains occurring by virtue of the method and the accompanying work hardening of the material used (steel sheets, aluminum sheets, or other metallic materials) allows one to achieve the greatest possible material strengths.

The drawbacks to conventional deep drawing are in particular the tendency of the component to spring back on account of the inhomogeneous stress state after the drawing and its sensitivity to batch variations. The anticipated spring back is factored in already during the design of the forming tools by incorporating the anticipated spring back values in opposite direction in the tool, using classical compensation measures such as the so-called "Forward Springback Compensation", in order thus to obtain the most dimensionally accurate component after the loading is relaxed, despite the inhomogeneous stress state. Since these measures are not enough, especially in the case of high-strength materials and especially in combination with slight sheet thicknesses, oftentimes straightening and/or calibrating processes are required to achieve the desired dimensional accuracy in further follow-up operations.

It is also a problem that, after a change of the material batch, such as a change of the coil, the dimensional accuracy of the components can no longer be maintained. As a result, costly measures must be adopted to readjust the straightening and/or calibrating processes and/or the deep drawing process and especially the force of the hold-down device need/needs to be individually attuned to the new batch. Also a lack of constancy of the tribological conditions in the tool results in unwanted deviations from the target geometry of the finished component.

Besides the above described advantages and drawbacks of the conventional deep drawing method, usually the so-called drawing edges still need to be cut off after the forming of components produced in such a way. This cutting usually constitutes one or more separate operations, requiring their own tooling and their own logistical system. Furthermore, the material utilization is often unfavorable due to the edge cutting, so that further costs are incurred.

In order to maintain a short process chain even so, it is possible to integrate the flange trimming in the last deep drawing operation. Although cost savings can be achieved in this way, some drawbacks remain, such as the accrual of cutting scraps, the creation of costly tooling, a costly tryout, unwanted spring back effects, limited dimensional accuracy, and vulnerability to process disruptions.

In the prior art, methods and devices are known for economizing on or greatly reducing the edge trimming of U-shaped or hat-shaped components, for example see the teachings in the patent applications DE 10 2007 059 251 A1, DE 10 2008 037 612 A1, DE 10 2009 059 197 A1, DE 10 2013 103 612 A1, DE 10 2013 103 751 A1. What the teachings have in common is that a preform is created in a first step of the process, which is as close as possible geometrically speaking to the finished form of the component, but in contrast with the latter it has few or no material additions for an edge trimming and therefore it comprises a defined material excess in typical subsections such as base region, frame region and/or in the flange region, if present, which is utilized in a second step of the process in order to adjust the desired dimensional accuracy of the component, including the edge contour, by a special swaging and/or calibrating of substantially the entire component with no further cutting operations. While this known method eliminates the aforementioned drawbacks of unwanted spring back and edge cutting, it may still have certain undesirable side effects of its own. While preforms produced in this way correspond to the desired geometry, the length of the cross section developments may vary so much in their edge contour, especially in the event of complex geometry of the component and also in connection with slight component thicknesses, due to fluctuations from a batch change and/or wear on the preforming tools and/or the tribological properties of tooling and material, that the preforms produced in this way cannot be worked, or only to a limited extent, in the following swaging and/or calibrating die. The method and the device can be further optimized in terms of process reliability.

SUMMARY

The problem which the invention proposes to solve is thus to provide a method and a device of this kind with which finished sheet metal preforms can be processed in a reliable manner in the swaging and/or calibrating die, especially with no final edge cutting, regardless of batch and/or tribology, especially with a repeatable geometry of the sheet metal preform.

This problem is solved by a method of this kind with the features of the present disclosure.

According to the invention, it is provided that the region directly bordering on the sheet metal preform edge of the sheet metal preform which has been cut at least in portions comprises a positive dimensional deviation at least for a portion in the cross section with respect to the developed length of the corresponding region of the finished formed sheet metal component for the swaging and/or calibrating.

It has been found that steps are required, especially for the production of the cut sheet metal preform, with which a repeatable geometry, especially as regards the position of the component edges of the cut sheet metal preform and thus the sheet metal preform edge essential for the later swaging/calibrating is assured. With the assurance of a repeatable geometry, especially regarding the spatial position of the edge of the cut sheet metal preform so produced, it is ensured that basically only the necessary material excess for the following swaging/calibrating step is present in every possible cross section of the sheet metal preform or the cut sheet metal preform.

The fabrication of the sheet metal preform can be done by means of any desired combinable forming methods in one or more steps. The preforming may involve, for example, a deep drawing type forming step. In particular, a multistage forming may also occur, comprising for example an embossing of the base region to be produced and a raising of the frame region to be created or optionally the forming of the flange region to be created. Also conceivable are any desired combinations of canting and/or bending and/or embossing in one or more successive operations. The deep drawing carried out for example for the preforming is done for example in one or more stages. The sheet metal preform obtained by the preforming may be seen in particular as a sheet metal component as close as possible to the final form, which corresponds as much as possible to the intended finished part geometry, taking into consideration existing boundary conditions such as spring back and forming capacity of the material used. At the end of the preforming process, in particular the deviation of the edge contour of the sheet metal preform from its finished sheet metal component form is preferably positive (with more material) at least in portions. The absolute deviation of the edge contour of the component preform with respect to the edge contour of the finished component form should be slight, due to a suitable design of the method within the bounds of technical possibilities, but this is often not possible in practice. Instead, the focus of the method design is to keep as low as possible the absolute deviation of the edge contour of the component preform with respect to each other in the course of the process.

Swaging/calibrating can mean in particular a finished forming or final forming of the cut sheet metal preform, which can be accomplished for example by one or more pressing processes. The resulting substantially finished formed sheet metal component can accordingly be understood as being a finally formed sheet metal component. However, it is possible for the substantially finished formed sheet metal component to be subjected to even further processing steps which modify the component, such as the making of attachment holes, the forming of end flanges, the making of collars and/or an edge trimming in one region. However, it is desirable to organize the calibrating such that basically no further forming steps are needed.

The initially produced sheet metal preform, as well as the cut sheet metal preform and finally the finished formed sheet metal component, have substantially a longitudinal extension and a transverse extension. Thus, cross section means a section through the transverse extension of the sheet metal preform/the cut sheet metal preform/the finished formed sheet metal component.

By flange region, if the sheet metal component is not flangeless, a flange section provided at least in portions on one side of the finished formed sheet metal component, at least on one side in the longitudinal extension and/or transverse extension, especially on both sides of the finished formed sheet metal component, which serves for example for the attachment of further components and is also known as a joining flange. The frame region is provided at least on one side of the finished formed sheet metal component in the longitudinal extension, especially on two opposite sides of the finished formed sheet metal component, wherein the finished formed sheet metal component comprises a substantially hat-shaped cross section, for example, with a respective frame region on both sides, where the frame regions may be identical in configuration, but also with different heights. Between the optional flange region and the frame region there is optionally provided a transitional region as a single piece. The base region is configured as a single piece with the frame region(s) across a further transitional region and need not be confined to one plane, depending on the complexity of the sheet metal component to be produced, but rather may also be provided in portions on different levels in the longitudinal extension. The transitions between the individual levels in the base region may be steplike or curved, in particular one may speak of a so-called offset design. The finished formed sheet metal component may also comprise other forms than longitudinal extension or lengthwise axial forms, for example, it may be arc-shaped, C-shaped, or L-shaped. According to one embodiment of the method, the cut sheet metal preform comprises a developed length at least for a portion in cross section which is between 0.5% and 4% longer in relation to the developed length of the finished formed sheet metal component. The developed length of such cross sections of the cut sheet metal preform is in sections or throughout preferably between 0.7% and 3.3% longer than those of the finished formed sheet metal component. If, on account of the process control during the production of the cut sheet metal preform, the developed length of the cross sections were to vary too much, not enough material excess would be available for the following swaging/calibrating step for a developed length which is too short, and this would impair the dimensional accuracy of the component. On the other hand, if the developed length of the particular cross section of the cut sheet metal preform is too large, the overdimensioned material excess would collapse into crimps during the subsequent calibrating process, which may mean an optical and/or dimensional defect.

According to one embodiment of the method, the material flow is specifically controlled at least in portions during the preforming of the metal sheet into the sheet metal preform. After numerous investigations and simulations it has been found that the material flow at least in portions can be specifically controlled with a force-operated blank or hold-down device, in particular braked, in order to thereby prevent unwanted formation of folds during the production of the sheet metal preform for particular sheet metal components due to their geometry. Alternatively or cumulatively, the material flow can be controlled in an advantageous manner by drawing beads and/or drawing steps arranged at least in portions during the production of the sheet metal preform, so that certain component geometries can be better produced.

According to one embodiment of the method, after the completion of the preforming of the metal sheet into the sheet metal preform, material stockpiles are provided or created as excess material at least in portions. Preferably, the material stockpile is introduced in the form of a bulge, a wave, and/or a slight folding during the production of the sheet metal preform. For example, the material stockpiles may be introduced or provided in the base region, in the frame region, optionally in the flange region, in the transitional region between base and frame region and/or optionally in the transitional region between frame and flange region.

According to one embodiment of the method, the material stockpiles are specifically introduced or provided via at least one preform tool. In this way, it is advantageously possible to produce in a reliable process even a preform having an increased tendency to form folds on account of its geometrical shape. Therefore, by specifically introduced material elevations, even such components with a tendency to form folds are amenable to the method of the invention.

The aforementioned problem is solved in a device according to the invention such that the cutting tool is designed such that in the region directly bordering on the sheet metal preform edge of the sheet metal preform which has been cut at least in portions there remains a positive dimensional deviation at least for a portion in the cross section with respect to the developed length of the corresponding region of the finished formed sheet metal component for the swaging and/or calibrating. As already mentioned, a repeatable geometry can be assured in the making of the cut sheet metal preform, especially as regards the position of the component edges of the cut sheet metal preform and thus the sheet metal preform edge essential to the subsequent swaging/calibrating. This ensures that the necessary material excess for the following swaging/calibrating step is present in every possible cross section of the cut sheet metal preform and therefore fluctuations resulting from batch changes and/or wear on the preforming tools and/or the tribological properties of tools and material can also be balanced out.

According to one embodiment of the device, the device comprises a preform tool having for example a preforming stamp, a preforming die and a blank holder. The base region of the preforming die may when required be released from the rest of the preforming die at least in portions and is movable, so as to form for example an (internal) hold-down device. In addition to the hold-down device, a blank holder may also be used. The production of the sheet metal preform may occur preferably by classic deep drawing. The preforming die may comprise at least one drawing bead and/or drawing step at least in portions, which positively supports in particular the ironing during the deep drawing to form the sheet metal preform and to ensure an adequate development in the transverse extension and/or longitudinal extension on the sheet metal preform. The fabrication to form the sheet metal preform may take place in two or more stages or preform tools, depending on the complexity of the sheet metal component to be produced.

For the controlled formation of the material stockpiles according to one embodiment of the device the at least one preform tool is designed to provide material stockpiles during the preforming of the metal sheet into the sheet metal preform, for example by deep drawing.

According to one embodiment of the device, the device comprises a cutting tool, especially for a cutting to be performed in a region on the sheet metal preform, having a hold-down device and a die. The hold-down device and the die are preferably designed to clamp the sheet metal preform between them, in particular with no further plastic shaping, especially apart from the intentional cutting. Optionally and alternatively, lesser shaping can also be integrated in portions. In other words, the contour of the hold-down device and the die, which contacts at least in portions the base region and the frame region of the sheet metal preform, in particular corresponds substantially to the contour of the desired sheet metal preform. In this way, it can be ensured that the measures implemented in the sheet metal preform for the swaging/calibrating are not compensated once again in the cutting tool. Furthermore, the cutting tool may comprise cutting elements which are movable relative to the stamp and/or die, especially in the form of cutting stamps and backstops. Alternatively to the cutting elements, a laser may also be used for the cutting (laser cutting).

According to one embodiment of the device, the device comprises a calibrating tool having a calibrating stamp, a calibrating die and a blocking element. The contour of the calibrating stamp and the calibrating die corresponds substantially to the base region, frame region and optional flange region, in particular the target geometry of the sheet metal component to be finished. The blocking element serves as an abutment during the swaging/calibrating, especially of the sheet metal edges in the flange region of the sheet metal component to be finished and thus it blocks a material flow away from the sheet metal component, so that directional stresses are produced in the sheet metal component to be finished in order to produce an especially dimensionally accurate sheet metal component. The blocking elements, as part(s) of the calibrating tool, may be movable relative to the calibrating stamp and/or calibrating die, either able to move coaxially up to both of them or able to move at an angle to and from them. Alternatively, the blocking element may be designed as a single piece in the calibrating die, especially as a step and/or protrusion, which may reduce the number of parts of the calibrating tool. The swaging/calibrating may also be done in two or more stages or calibrating tools.

According to one embodiment of the device, the device is integrated in a progressive press. In particular in the production of mass consumer products, such as products in the vehicle industry, products such as sheet metal components are produced especially economically in progressive presses.

BRIEF DESCRIPTION OF THE DRAWINGS

In the following, the invention shall be explained more closely with the aid of drawings. The same parts are given the same reference numbers. Specifically, there are shown:

FIG. 5 is an exemplary embodiment of a first finished sheet metal component; and FIG. 6 is an exemplary embodiment of a second finished sheet metal component.

DETAILED DESCRIPTION

Figure 1:
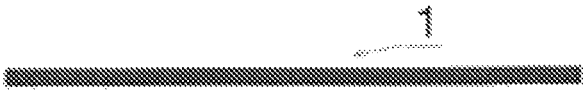
FIG. 1 is a cross section through a flat metal sheet.

FIG. 1 shows for example a flat metal sheet (1) in cross section, which is unwound from a coil, not shown, and cut to length, and which is provided in particular as a defined blank cutout to the further process. Preferably, the metal sheet (1) is made from a steel material, preferably from a high-strength steel material. Alternatively, aluminum materials or other metals may also be used. The metal sheet may also be provided as a tailored product.

Figure 2A:
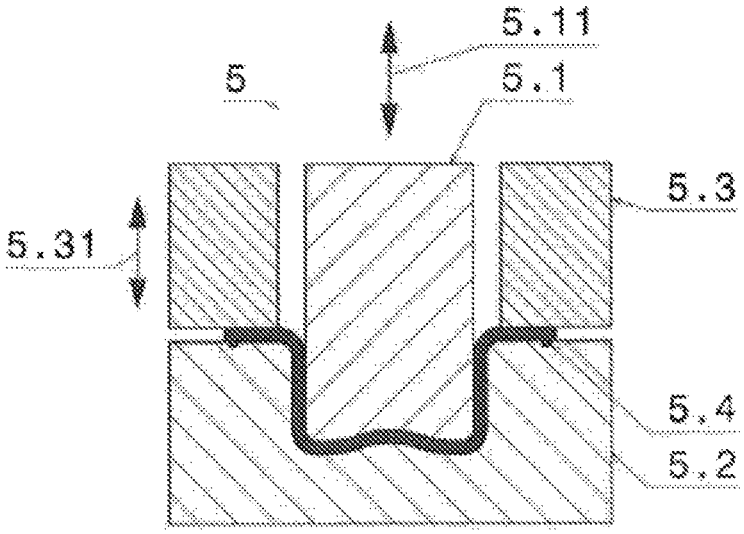
FIGS. 2*a, b* is an exemplary embodiment of a preform tool according to the invention to carry out an exemplary embodiment of a sheet metal preform according to the invention.
Figure 2B:
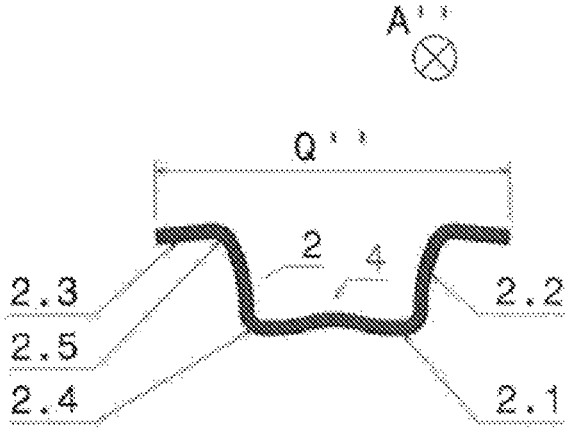
Figure 3A:
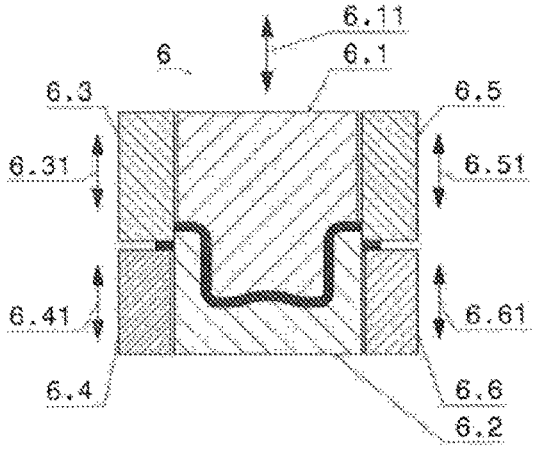
FIGS. 3*a, b* is an exemplary embodiment of a cutting tool according to the invention to carry out an exemplary embodiment of a cut sheet metal preform according to the invention.
Figure 3B:
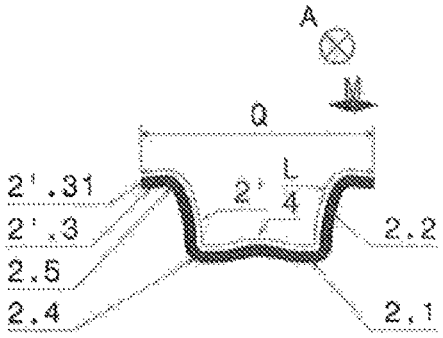

According to the invention, it is provided that the metal sheet (1) is at first formed with customary methods such that the geometry of the sheet metal preform (2) is provided with a material excess, for example in the form of at least one material stockpile (4) in the base region (2.1) for the further processes. The material excess may also alternatively or cumulatively be provided in the frame region (2.2), in the flange region (2.3) and/or in the transitional regions (2.4, 2.5) between base region (2.1), frame region (2.2) and flange region (2.3), not shown here. The sheet metal preform (2) may preferably be produced by classic deep drawing. The sheet metal preform (2) is produced for example in a preform tool (5), whereby the flat metal sheet (1) is placed in the opened preform tool (5) with suitable means, not shown here, and then a preforming stamp (5.1), a preforming die (5.2) and at least one blank holder (5.3) act on the metal sheet (1). The movement and/or travel of the components of the preform tool (5) is shown symbolically by the double arrows (5.11, 5.31). After the inserting of the metal sheet (1), the blank holder (5.3) clamps the metal sheet (1). After this, the preforming stamp (5.1) travels in the direction UT and forms the metal sheet (1) into a sheet metal preform (2). The blank holder (5.3) may be distanced or subjected to a force. The preforming die (5.2) may comprise at least one drawing bead and/or drawing step (5.4) at least in portions, which positively supports in particular the ironing during the deep drawing to form the sheet metal preform (2) and ensures an adequate development in the transverse extension (Q") and/or longitudinal extension (A") on the sheet metal preform (2), as well as avoidance of unwanted folding. For the controlled formation of the material stockpile (4), for example, the preforming stamp (5.1), possibly in combination with an inner hold-down device (not shown here), is designed to introduce material stockpiles (4) during the preforming of the metal sheet (1) to form the sheet metal preform (2). Thanks to the introducing or providing of the formation of the material stockpile (4) during the production of the sheet metal preform (2), besides the overdimensioning of the sheet metal preform (2) it is also possible to take into account the material excess needed for the swaging/calibrating in the form of material stockpiles (4) in the preform tool (5). The production of the sheet metal preform (2) is not limited to one preform tool (5), but instead depending on the complexity of the sheet metal component (3) to be produced it can be done in two or more stages or preform tools (not shown here). FIG. 2*a*) shows the preform tool (5) at the so-called bottom dead center. After the forming, the sheet metal preform (2) is removed from the preform tool (5), which comprises a spring back on account of an unavoidable inhomogeneous stress state introduced into the sheet metal preform (2) (FIG. 2*b*). In the design of the preform tool (5) compensatory measures may already be adopted in order to obtain a sheet metal preform (2) corresponding as much as possible to the final geometry. Fluctuations in the spring back are evened out in the swaging/calibrating process, so that no expensive correction grinding is required here. The same holds for fluctuations which may result from batch changes and/or wear on the preforming tools and/or the tribological properties of tools and material. The sheet metal preform (2) has for example a transverse extension (Q") and a longitudinal extension (A"), the longitudinal extension (A") being for example a multiple higher than the transverse extension (Q") and being represented symbolically in the plane of the drawing.

The removed sheet metal preform (2) is placed in a cutting tool (6), comprising a hold-down device (6.1) and a die (6.2). The hold-down device (6.1) and the die (6.2) are preferably designed to clamp or fix the sheet metal preform (2) between them and in particular with no further plastic shaping. The contour of the hold-down device (6.1) and the die (6.2), which contact at least in portions the base region (2.1) and frame region (2.2) of the sheet metal preform (2), correspond substantially to the contour of the preforming stamp (5.1) and the preforming die (5.2). In this way, it can be ensured that the measures implemented in the sheet metal preform (2) for the swaging/calibrating are not influenced in a negative manner in the cutting tool. Alternatively, additional plastic forming can be integrated in the cutting tool through appropriate measures, such as embossing, etc. Furthermore, the cutting tool (6) comprises cutting elements (6.3, 6.4, 6.5, 6.6) which are movable relative to the hold-down device (6.1) and/or die (6.2). The movement and/or travel of the components of the cutting tool (6) is shown symbolically by the double arrows (6.11, 6.31, 6.41, 6.51, 6.61). The sheet metal preform (2) is cut in such a way that the developed length (L) of the cut sheet metal preform (2') in cross section is between 0.5% and 4% longer than the developed length (L') of the finished formed sheet metal component (3). In particular, the cut sheet metal preform (2') comprises a longer flange region (2'.3, M) than the flange region (3.3, M') of the finished formed sheet metal component (3). At least a portion of the flange region (2'.3) is then cut off in the cutting tool (6) in a cutting or stamping process, in order to produce in this way a repeatable cross sectional development or a sheet metal preform edge (2'.31) for the following swaging/calibrating process. Four movable cutting elements (6.3, 6.4, 6.5, 6.6) are represented, which may be individually designed as cutting blades (6.3, 6.5) and movable backstops (6.4, 6.6). The number of cutting elements is not fixed at four, but instead only one cutting element can also be provided for each side, which can act in a cutting manner from above or from below on the flange region (2.3) of the sheet metal preform (2). The cut sheet metal preform (2') has a transverse extension (Q) in cross section and possibly a longitudinal extension (A) which is smaller as compared to the transverse extension (Q") and possibly the longitudinal extension (A") of the sheet metal preform (2).

Figure 4A:
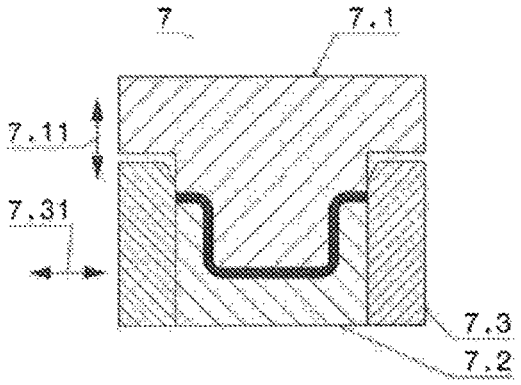
FIGS. 4*a, b* is an exemplary embodiment of a calibrating tool according to the invention to carry out an exemplary embodiment of calibrating according to the invention.

The cut sheet metal preform (2') removed from the cutting tool (6) still comprises a spring back, such as before it was inserted, and it is placed in a calibrating tool (7), which comprises a calibrating stamp (7.1) and a calibrating die (7.2). FIG. 4*a*) shows the calibrating tool (7) at the bottom dead center. Furthermore, the calibrating tool (7) comprises in particular a blocking element (7.3), which acts as an abutment on the encircling edge (2'.31) of the cut sheet metal preform (2'), in order to bring about the final geometry of the finished formed sheet metal component (FIG. 4*b*) close to the final form by means of compressive stress superpositioning during the swaging/calibrating. The movement and/or travel of the components of the calibrating tool (7) is shown symbolically by the double arrows (7.11, 7.21, 7.31). From the cut sheet metal preform (2'), comprising in cross section a developed length (L) between 0.5% and 4% longer than the developed length (L') of the finished formed sheet metal component (3) and the cut sheet metal preform (2') comprising a longer flange region (2'.3, M) than the flange region (3.3, M') of the finished formed sheet metal component (3), a highly dimensionally accurate and flanged sheet metal component (3) is produced in the calibrating tool (7).

Besides the in longitudinal extension (A') and transverse extension (Q'), which is for example smaller by a multiple than the longitudinal extension (A'), with a base region (3.1) and a frame region (3.2) formed substantially in a same plane, comprising substantially the same height (T) on both sides FIG. 4*b*), offset sheet metal components (3') can also be designed with a base region (3'.1) on different levels and with different heights (T, $T_1$, $T_2$) of the frame regions (3.2, 3'.2), especially in longitudinal extension (A') on both sides (FIG. 5). Other forms, such as C-shaped sheet metal components (3") in their longitudinal extension (A'), can also be produced in dimensionally accurate manner, especially with a flange region (3.3) (FIG. 6).

In all embodiments, according to the invention the region (2.2, 2.5, 2.3) bordering directly on the sheet metal preform edge (2'.31) of the sheet metal preform (2') which has been cut at least in portions comprises a positive dimensional deviation (M) at least for a region in the cross section with respect to the developed length (M') of the corresponding region (3.2, 3.5, 3.3) of the finished formed sheet metal component (3, 3', 3") for the swaging and/or calibrating. In particular, the positive dimensional deviation (M) in the above embodiments corresponds for example in cross section (Q) to a longer flange region (2'.3) of the cut sheet metal preform (2') with respect to the developed length (M') of the flange region (3.3) of the finished formed sheet metal component (3, 3', 3").

The invention is not limited to the embodiments shown. Other component shapes are likewise possible and will require suitably adapted tool contours.

LIST OF REFERENCE NUMBERS

1 Flat metal sheet
2 Sheet metal preform
2.1 Base region of the sheet metal preform and the cut sheet metal preform
2.2 Frame region of the sheet metal preform and the cut sheet metal preform
2.3 Flange region of the sheet metal preform
2.4 Transitional region between base region and frame region of the sheet metal preform and the cut sheet metal preform
2.5 Transitional region between frame region and flange region of the sheet metal preform and the cut sheet metal preform
2' Cut sheet metal preform
2'.3 Cut flange region
2'.31 Sheet metal preform edge of the cut sheet metal preform
3, 3', 3" Finished formed sheet metal component
3.1 Base region of the finished formed sheet metal component
3'.1 Offset base region of the finished formed sheet metal component
3.2 Frame region of the finished formed sheet metal component
3.3 Flange region of the finished formed sheet metal component
3.4 Transitional region between base region and frame region of the finished formed sheet metal component
3.5 Transitional region between frame region and flange region of the finished formed sheet metal component
4 Material stockpile as swaging addition
5 Preform tool
5.1 Preforming stamp
5.11 Direction of movement of the preforming stamp
5.2 Preforming die
5.3 Blank holder
5.31 Direction of movement of the blank holder
5.4 Braking bead/braking bulge on the preforming die
6 Cutting tool
6.1 Hold-down device
6.11 Direction of movement of the hold-down device
6.2 Die
6.3-6.6 Cutting elements, cutting blades and backstops
6.31-6.61 Direction of movement of the cutting elements
7 Calibrating tool
7.1 Calibrating stamp
7.11 Direction of movement of the calibrating stamp
7.2 Calibrating die
7.21 Direction of movement of the calibrating die
7.3 Blocking element
7.31 Direction of movement of the blocking element
A Longitudinal extension of the cut sheet metal preform
A' Longitudinal extension of the finished formed sheet metal component
A" Longitudinal extension of the sheet metal preform
L Developed length in cross section of the cut sheet metal preform
L' Developed length in cross section of the finished formed sheet metal component
M Positive dimensional deviation in the flange region of the cut sheet metal preform
M' Swaged/calibrated flange region
Q Transverse extension of the cut sheet metal preform
Q' Transverse extension of the finished formed sheet metal component
Q" Transverse extension of the sheet metal preform
T, $T_1$, $T_2$ Height of the frame region

The invention claimed is:

1. A method for producing a sheet metal component using a preform tool, a cutting tool and a calibrating tool, wherein the method comprises the following steps:

preforming, in the preform tool, a metal sheet into a sheet metal preform comprising at least one base region, a frame region, and a first transitional region between the base region and the frame region, wherein at least one of the regions comprises excess material at least in portions;

subsequent to the preforming, cutting, in the cutting tool, the sheet metal preform at least in portions to form a cut sheet metal preform with a sheet metal preform edge, the cut sheet metal preform having a cut developed length resulting from the cutting: and subsequent to the cutting, calibrating, in the calibrating tool, the sheet metal preform to form a substantially finished formed sheet metal component having a calibrated developed length resulting from the calibrating;

wherein the cut length is longer than the calibrated length;

wherein the cut developed length at least for a portion in cross section which is between 0.5% and 4% longer in relation to the calibrated developed length of the finished formed sheet metal component.

2. The method as claimed in claim 1, wherein a material flow is specifically controlled at least in portions during the preforming of the metal sheet into the sheet metal preform.

3. The method as claimed in claim 2, wherein after the completion of the preforming of the metal sheet into the sheet metal preform, material stockpiles are provided as excess material at least in portions.

4. The method as claimed in claim 3, wherein the material stockpiles are specifically introduced via the preform tool.

* * * * *